US007505719B2

(12) United States Patent
Edmunds

(10) Patent No.: US 7,505,719 B2
(45) Date of Patent: Mar. 17, 2009

(54) COMPOSITE TRIM BAR FOR DEVELOPER SYSTEM

(75) Inventor: Cyril G. Edmunds, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 414 days.

(21) Appl. No.: 11/454,646

(22) Filed: Jun. 16, 2006

(65) Prior Publication Data

US 2007/0292167 A1 Dec. 20, 2007

(51) Int. Cl.
*G03G 15/09* (2006.01)

(52) U.S. Cl. ..... 399/274

(58) Field of Classification Search ..... 399/269, 399/274, 284

See application file for complete search history.

(56) References Cited

U.S. PATENT DOCUMENTS 4,624,545 A * 11/1986 Yasuda et al. ..... 399/274
5,412,458 A * 5/1995 Kamaji et al. ..... 399/284
5,495,321 A 2/1996 Sunaga et al.
6,423,427 B1 * 7/2002 Mehmood ..... 428/682
6,473,587 B2 10/2002 van Woerkens

OTHER PUBLICATIONS

Co-pending U.S. Appl. No. 11/263,370, filed Oct. 31, 2005, entitled "Xerographic Developer UnitHaving Variable Pitch Auger" by Steven C. Hart et al.

Co-pending U.S. Appl. No. 11/263,371, filed Oct. 31, 2005, entitled "Developer Housing Design With Improved Sump Mass Variation Latitude" by Steven C. Hart et al.

* cited by examiner

*Primary Examiner*—William J Royer
(74) *Attorney, Agent, or Firm*—Lloyd F. Bean, II

(57) ABSTRACT

A device for metering toner to a predefined toner bed height on a donor member, including a composite trim bar having a support portion and a cutting portion, adjacent to the donor member, attached to the support portion.

14 Claims, 3 Drawing Sheets

COMPOSITE TRIM BAR FOR DEVELOPER SYSTEM

TECHNICAL FIELD

The present disclosure relates generally to an electrostatographic or xerographic printing machine, and more particularly concerns a composite trim blade utilized in a development subsystem.

BACKGROUND AND SUMMARY

Generally, an electrophotographic printing machine includes a photoconductive member which is charged to a substantially uniform potential to sensitize the surface thereof. The charged portion of the photoconductive member is exposed to an optical light pattern representing a document being produced. This records an electrostatic latent image on the photoconductive member corresponding to informational areas contained within the document. After the electrostatic latent image is formed on the photoconductive member, the electrostatic latent image is developed by bringing a developer material into proximal contact therewith. Typically, the developer material comprises toner particles adhering triboelectrically to carrier granules. The toner particles are attracted to the electrostatic latent image from the carrier granules and form a powder image on the photoconductive member which is subsequently transferred to a copy sheet. Finally, the copy sheet is heated or otherwise processed to permanently affix the powder image thereto in the desired image-wise configuration.

In the prior art, both interactive and non-interactive development has been accomplished with magnetic brushes. In typical interactive embodiments, the magnetic brush is in the form of a rigid cylindrical sleeve which rotates around a fixed assembly of permanent magnets. In this type of development system, the cylindrical sleeve is usually made of an electrically conductive, non-ferrous material such as aluminum or stainless steel, with its outer surface textured to improve developer adhesion. The rotation of the cylindrical sleeve transports magnetically adhered developer through a development zone where there is direct contact between the magnetic brush and an imaged surface, and toner is stripped from passing magnetic brush filaments by electrostatic fields of an image.

A commonly used development technique involves a single component developer material, comprised mainly of toner particles. In a typical single component development system, each toner particle has both magnetic properties (to allow the toner particles to be magnetically conveyed to an imaging member) and an electrostatic charge (to enable the toner particles to adhere to the imaging member). In such a system, a developer roll is in the form of a cylindrical sleeve which rotates about a stationary magnet assembly. The magnetized toner particles adhere to the rotating cylindrical sleeve by the force of stationary magnets with the cylindrical sleeve.

In a single component development system, the toner particles are charged by a charge-metering member or a trim blade. The charge-metering member is typically in continuous contact with the toner particles along one portion or longitude of the developer roll. The charge-metering member performs two simultaneous functions: it allows a uniform metered layer of toner particles to pass underneath, and uniformly charges the toner particles that are mechanically metered. That is, the action of the toner particles rubbing against the charge-metering member and each other while being metered by the charge-metering member induces a charge on the toner particles. The uniformity of a nip formed between the charge-metering member and the developer roll plays a significant role in creating a uniform charge and uniform layer of toner particles across the developer roll. The charged toner particles on the surface of the developer roll are advanced towards the imaging member, and then transferred onto the imaging member in image-wise configuration to form a developed toner image on the imaging member. The toner image is subsequently transferred and fused to paper.

In the prior art, the trim blade typically comprises an angled, resilient straight edge blade urged against the surface of the developer roll along the length thereof. The trim blade consists of a metal substrate. The trim blade is oriented so that the edge portion of the trim blade contacts toner particles on the surface of the developer roll in order to smooth the layer of toner particles.

A significant disadvantage to conventional trim blades is that they deteriorate rather quickly. Particularly, the surface of the trim blade that contacts the toner particles tends to wear down over time. As the charge-metering member is responsible for creating a uniform layer of toner across the developer roll, a deteriorated or worn trim blade compromises print quality. A smooth contact surface on the trim blade is necessary to promote an even layer of toner particles. When a trim blade wears out, indicated by degradation in the quality of the final image, it is necessary for a customer to replace it with a new trim blade. Often, this involves replacing a number of system elements that are collectively provided in a Customer Replaceable Unit (CRU). When a trim blade wears out, the entire CRU must be replaced, which is an expensive and time-consuming process.

The above problem is more acute in developers employing Magnetic Ink Character Recognition (MICR) toner which toner tends to be very abrasive because of the magnetite in the toner. Applicants have found that inexpensive aluminum trim bars tend to wear out quickly causing high service cost and stainless steel trim bars have much better wear characteristics but are hard to manufacture.

SUMMARY

There is provided a device for metering toner to a predefined toner bed height on a donor member including a composite trim bar having a support portion; and a cutting portion, adjacent to the donor member, attached to the support portion.

DETAILED DESCRIPTION

Figure 1:
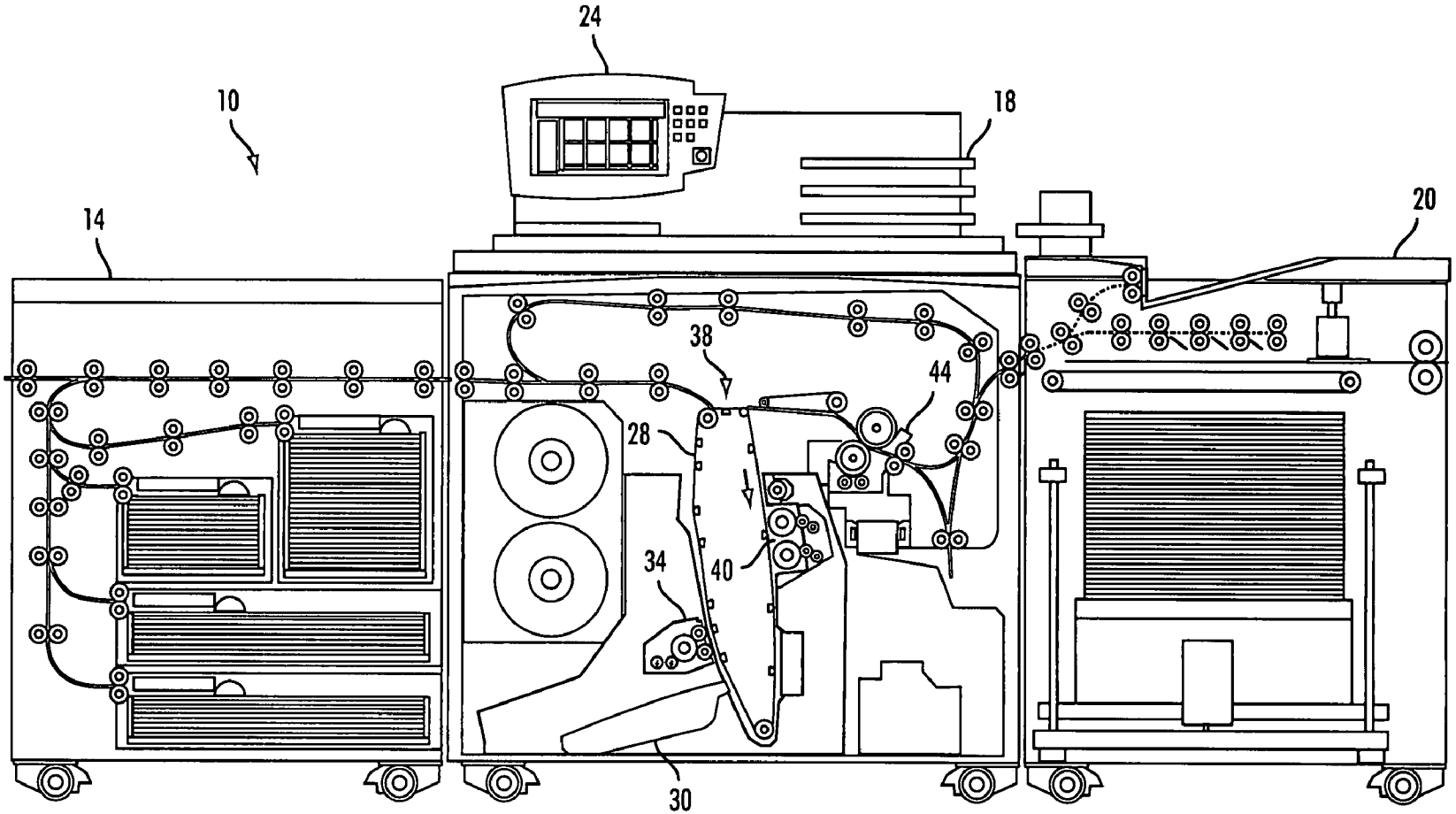
FIG. 1 is an elevational view of an electrostatographic printing apparatus incorporating a semiconductive magnetic brush development (SCMB) system having two magnetic rolls.

FIG. 1 is an elevational view of an electrostatographic printing apparatus (printing machine) 10, such as a printer or copier, having a development subsystem that uses two magnetic rolls for developing toner particles that are carried on semiconductive carrier particles. The printing machine 10 includes a feeder unit 14, a printing unit 18, and an output unit 20. The feeder unit 14 houses supplies of media sheets and substrates onto which document images are transferred by the printing unit 18. Sheets to which images have been fixed are delivered to the output unit 20 for correlating and/or stacking in trays for pickup.

The printing unit 18 includes an operator console 24 where job tickets may be reviewed and/or modified for print jobs performed by the printing machine 10. The pages to be printed during a print job may be scanned by the printing machine 10 or received over an electrical communication link. The page images are used to generate bit data that are provided to a raster output scanner (ROS) 30 for forming a latent image on a photoreceptor 28. Photoreceptor 28 continuously travels the circuit depicted in the figure in the direction indicated by the arrow. A development subsystem 34 develops toner on the photoreceptor 28. At a transfer station 38, the toner conforming to the latent image is transferred to the substrate by electric fields generated by the transfer station 38. The substrate bearing the toner image travels to a fuser station 44 where the toner image is fixed to the substrate. The substrate is then carried to the output unit 20. This description is provided to generally describe the environment in which a double magnetic roll development system for developer having semiconductive carrier particles may be used and is not intended to limit the use of such a development subsystem 34 to this particular printing machine environment.

Figure 2:
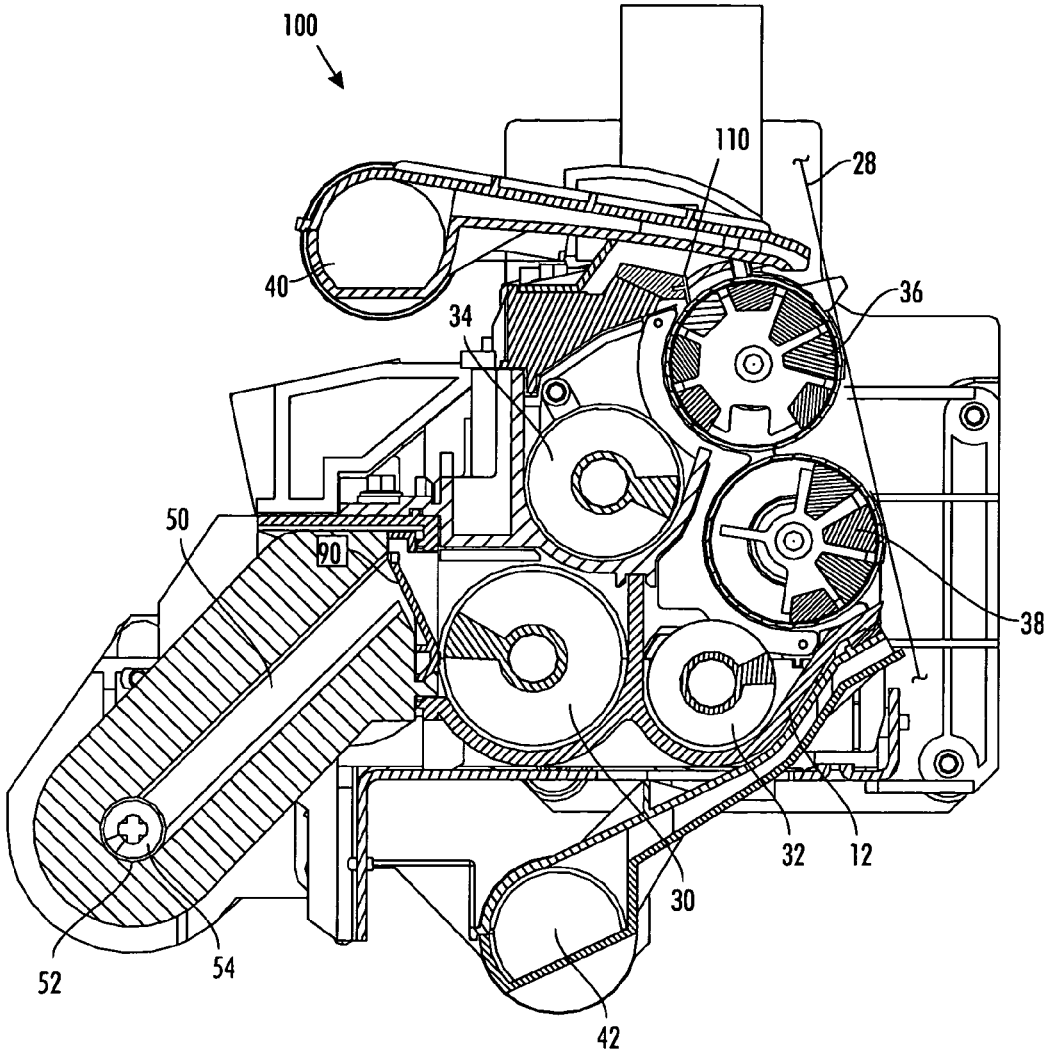
FIG. 2 is a sectional view of a SCMB developer unit having two magnetic rolls.

The overall function of developer unit 100, which is shown in FIG. 2, is to apply marking material, such as toner, onto suitably-charged areas forming a latent image on an image receptor such as the photoreceptor 28, in a manner generally known in the art. The developer unit 100, however, provides a longer development zone while maintaining an adequate supply of developer having semiconductive carrier particles than development systems previously known. In various types of printers, there may be multiple such developer units 100, such as one for each primary color or other purpose.

Among the elements of the developer unit 100, which is shown in FIG. 2, are a housing 12, which functions generally to hold a supply of Developer material having semiconductive carrier particles, as well as augers, such as 30, 32, 34, which variously mix and convey the developer material, and magnetic rolls 36, 38, which in this embodiment form magnetic brushes to apply developer material to the photoreceptor 28. Other types of features for development of latent images, such as donor rolls, paddles, scavengeless-development electrodes, commutators, etc., are known in the art and may be used in conjunction with various embodiments pursuant to the claims. In the illustrated embodiment, there is further provided air manifolds 40, 42, attached to vacuum sources (not shown) for removing dirt and excess particles from the transfer zone near photoreceptor 28. As mentioned above, a two-component developer material is comprised of toner and carrier. The carrier particles in a two-component developer are generally not applied to the photoreceptor 28, but rather remain circulating within the housing 12. The augers 30, 32, and 34 are configured and cooperate in a manner described in co-pending U.S. application Ser. No. 11/263,370, which was filed on Oct. 31, 2005, entitled "Xerographic Developer Unit Having Variable Pitch Auger," and co-pending U.S. application Ser. No. 11/263,371, which was filed on Oct. 31, 2005, entitled "Developer Housing Design With Improved Sump Mass Variation Latitude", both of which are hereby expressly incorporated herein in their entireties by reference and are commonly assigned to the assignee of this patent application.

Figure 3:
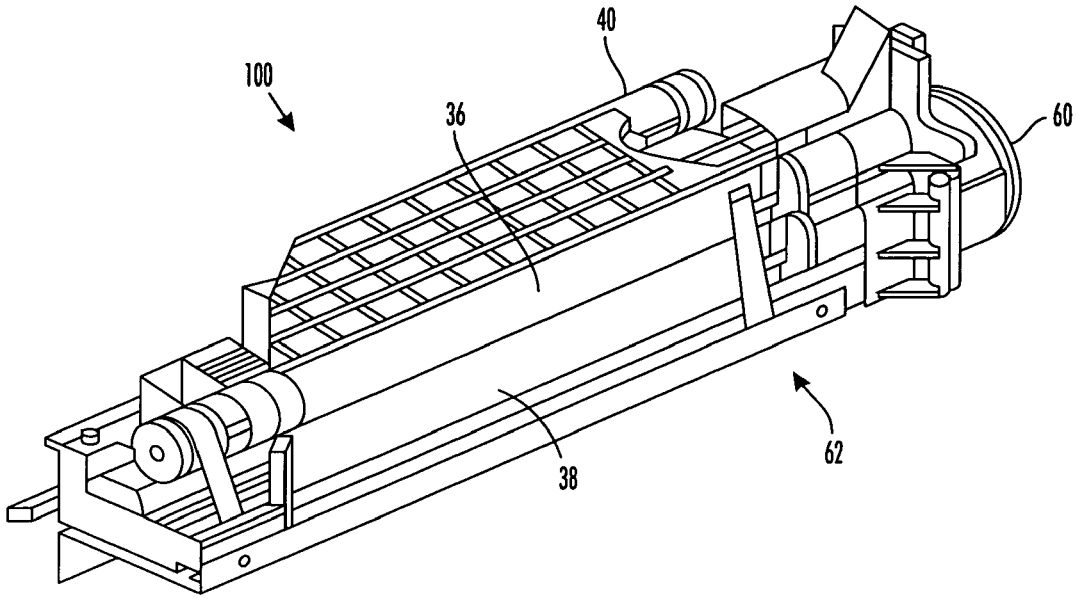
FIG. 3 is a perspective view of a SCMB developer unit having two magnetic rolls.

FIG. 3 is a perspective view of a portion of developer unit 100. As can be seen in this embodiment, the upper magnetic roll 36 and the lower magnetic roll 38 form a development zone that is approximately as long as the two diameters of the magnetic rolls 36 and 38. As further can be seen, a motor 60 is used with a mechanism, generally indicated with reference numeral 62, to cause rotation of the various augers 30, 32, and 34, magnetic rolls 36 and 38, and any other rotatable members within the developer unit 100 at various relative velocities. There may be provided any number of such motors. The magnetic rolls 36 and 38 are rotated in a direction that is opposite to the direction in which the photoreceptor 28 moves past the developer unit 100. That is, the two magnetic rolls 36 and 38 are operated in the against mode for development of toner. In one embodiment of the developer unit 100, the motor 60 and the mechanism 62 cause the magnetic rolls 36 and 38 to rotate at a speed in the range of about 1 to about 1.5 times the rotational speed of the photoreceptor 28. This rotational speed is lower than the rotational speed of magnetic rolls 36 and 38 in developer systems that rotate in the same direction as the photoreceptor 28. That is, the magnetic rolls 36 and 38 operated in the against mode may be rotated at lower speeds than magnetic rolls 36 and 38 operated in the with mode. These slower speeds increase the life of the magnetic rolls 36 and 38 over the life of magnetic rolls 36 and 38 that are operated in the with mode to develop toner carried on semiconductive carrier particles.

As is well known, magnetic rolls, such as magnetic rolls 36 and 38, are comprised of a rotating sleeve and a stationary core in which magnets are housed. In order to provide a surface that impedes the slippage of carrier particles as the outer sleeve rotates, the outer surface of the rotating sleeve may be sand-blasted or grooved. Previously known SCMB systems used sand-blasted stainless steel rollers, but these rollers have relatively short functional life of approximately 2 million prints or copies. Other known magnetic brush systems that use other types of developers used grooved stainless steel rollers having a depth of approximately 200 to 250 microns. The use of these grooved rollers in a double magnetic roller development subsystem operating in the against mode reduced a trim gap for the development subsystem from approximately 0.7 mm to approximately 0.135 mm. The trim gap is the distance between a trim blade and the upper magnetic roll 36. The trim blade assists in the removal of excess developer from the upper magnetic roll 36 before it is carried into the development zone.

A narrow trim gap presents issues with respect to the manufacturing of the developer unit 100. For one, the tolerances for the components that comprise the trim blade that assists in the removal of carrier particles from the upper magnetic roll 36 are more difficult to meet. More precise manufacturing techniques and higher rejection rates increase the unit manufacturing cost for the trim blade. Additionally, a narrower trim gap requires greater torque from the motor driving the roller and it also increases the aging of the developer.

Figure 4:
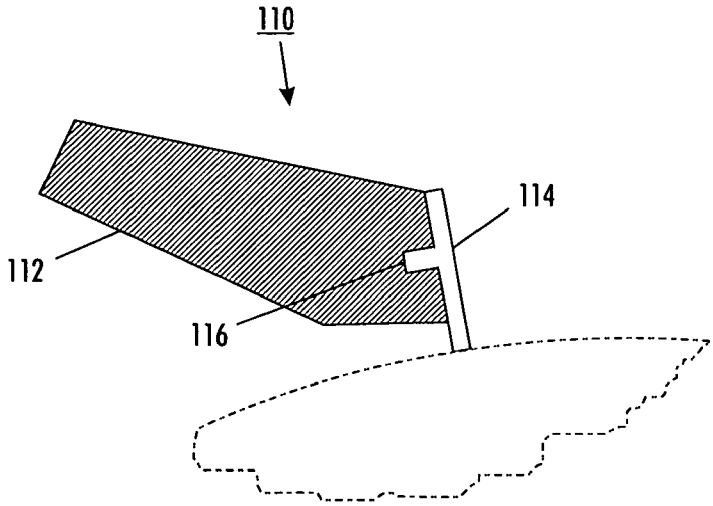
FIG. 4 is a sectional view of the trim blade of the present disclosure.

Now focusing on FIG. 4, trim blade 110 of the present disclosure divides the function of a trim blade 110 into two separate parts: support and cutting edge. In an embodiment of the present disclosure a bottom bar is made of a support with a stainless steel shim screwed on to form the cutting edge.

As illustrated in FIG. 2, trim blade 110 meters toner to a predefined toner bed height on the magnetic roll 36. The trim blade 110 having a support portion 112; and a cutting portion 114, adjacent to the magnetic roll 36; the support portion 112 is a major portion of the trim blade 110 and the cutting portion 114 is a minor portion of the trim blade 110. The cutting portion 114 is attached to the support portion 112 by a fastener 116, i.e., a screw or other suitable means can be employed such as welding or heat staking (in case of plastic. The cutting portion 114 has a wear factor substantially higher than the Support portion. Preferably the support portion 112 is made from aluminum or other suitable materials can be employed such as steel, plastics or other metals. Preferably the cutting portion 114 is made from stainless steel or other suitable materials can be employed such as nickel or carbon composites. Preferably the cutting portion 114 has a thickness between 0.5 mm and 5 mm; the support portion 112 has a thickness between 2 mm and 10 mm and, the cutting portion 114 has a wear factor substantially higher than the support portion 112. Note that if the support portion 112 has a longer life than the cutting portion 114 (which is likely), the cutting portion 114 can be replenished by replacing the stainless part only.

In recapitulation, there has been provided a robust trim bar design for use in two component development or donor loading systems. Developer is metered onto a developer roll at a trim position, and a gap between a trim bar and the developer roll sets a developer supply and thus to a large extent controls developability. Any excessive trim bar wear, due to developer grinding, will alter print quality. Aluminum trim bars wear excessively, particularly when magnetically pigmented toner is used, and stainless steel bars, while more durable are very expensive and difficult to manufacture. The function of the trim bar of the present disclosure is divided into two separate parts: the support and the cutting portion (cutting edge). The support portion being less critical is made from extruded aluminum. The cutting edge, that controls the developer roll to trim gap, can be made from a commercially available stainless steel shim and then fastened to the aluminum support portion. This composite provides a highly durable steel trim edge at much lower cost than a thick steel bar.

An advantageous feature of the present disclosure is that the cutting portion and/or support portion can have magnetic properties depending on the xerographic process employing a ferromagnetic developer material. For example the cutting portion could have non magnetic properties to prevent the developer material from collecting on the edge combined with a support portion having magnetic properties to magnetically move developer material away from the edge.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A device for metering developer material to a predefined developer material bed height on a donor member, comprising:

a composite trim bar having a support portion; and a cutting portion, adjacent to the donor member, attached to said support portion, said cutting portion has an edge portion having non magnetic properties to prevent the developer material from collecting on an edge of said cutting portion, said support portion having magnetic properties to magnetically move developer material away from the edge.

2. The device of claim 1, wherein said support portion comprises aluminum, steel, plastics or other metals.

3. The device of claim 1, wherein said cutting portion comprises stainless steel, nickel or carbon composites.

4. The device of claim 1, wherein said cutting portion has a thickness between 0.5 mm and 5 mm.

5. The device of claim 1, wherein said support portion has a thickness between 2 mm and 10 mm.

6. The device of claim 1, wherein said cutting portion has a wear factor substantially higher than said support portion.

7. The device of claim 1, further comprising means for attaching said support portion to said cutting portion.

8. The device of claim 1, wherein said support portion is a major portion of said trim bar and a cutting portion is a minor portion of said trim bar.

9. An electrostatic printing machine having a developer system including a device for metering developer material to a predefined developer material bed height on a donor member, comprising:

a composite trim bar having a support portion; and a cutting portion, adjacent to the donor member, attached to said support portion, said cutting portion has an edge portion having non magnetic properties to prevent the developer material from collecting on an edge of said cutting portion, said support portion having magnetic properties to magnetically move developer material away from the edge.

10. The device of claim 9, wherein said support portion comprises aluminum, steel, plastics or other metals.

11. The device of claim 9, wherein said cutting portion comprises stainless steel, nickel or carbon composites.

12. The device of claim 9, wherein said cutting portion has a thickness between 0.5 mm and 5 mm.

13. The device of claim 9, wherein said support portion has a thickness between 2 mm and 10 mm.

14. The device of claim 9, wherein said cutting portion has a wear factor substantially higher than said support portion.

* * * * *